US005436108A

United States Patent [19]

Freedman et al.

[11] Patent Number: 5,436,108

[45] **Date of Patent: * Jul. 25, 1995**

[54] THERMOGRAPHIC IMAGE-RECORDING MATERIALS

[75] Inventors: James R. Freedman, Newton Centre; Marcis M. Kampe, Brookline; Peter Viski, Lexington; Kent M. Young, Carlisle, all of Mass.

[73] Assignee: Polaroid Corporation, Cambridge, Mass.

[ * ] Notice: The portion of the term of this patent subsequent to Jul. 12, 2011 has been disclaimed.

[21] Appl. No.: 259,556

[22] Filed: Jun. 14, 1994

[51] Int. Cl.[6] ..... G03C 8/12; G03C 8/40

[52] U.S. Cl. ..... 430/200; 430/222; 430/616; 430/618; 430/964

[58] Field of Search ..... 430/200, 203, 222, 616, 430/618, 964

[56] References Cited

U.S. PATENT DOCUMENTS

| | | | |
|---|---|---|---|
| 3,719,489 | 6/1971 | Cieciuch et al. | 430/222 |
| 4,098,783 | 7/1978 | Cieciuch et al. | 430/222 |
| 4,260,677 | 4/1981 | Winslow et al. | 430/618 |
| 4,753,862 | 6/1988 | Sato et al. | 430/138 |
| 5,316,887 | 5/1994 | Arnost et al. | 430/203 |
| 5,320,929 | 6/1994 | Arnost et al. | 430/203 |
| 5,328,799 | 7/1994 | Freedman et al. | 430/203 |

FOREIGN PATENT DOCUMENTS

| | | |
|---|---|---|
| 0385383 | 9/1990 | European Pat. Off. . |
| 59-180548 | 10/1984 | Japan . |

*Primary Examiner*—Richard L. Schilling
*Attorney, Agent, or Firm*—Edward W. Black

[57] ABSTRACT

A thermographic dye transfer image-recording material is provided wherein a particular silver salt complex is employed as a source of silver ions, made available upon imagewise heating, to cleave a dye-providing material to provide a diffusible dye in an imagewise pattern corresponding to said imagewise heating. The silver salt complexes have improved solubility in the system providing for enhanced transferred image density.

25 Claims, No Drawings

THERMOGRAPHIC IMAGE-RECORDING MATERIALS

BACKGROUND OF THE INVENTION (1) Field of the Invention

The present invention relates to a thermographic dye transfer image-recording material and more particularly to one capable of providing images having enhanced image density.

(2) Description of the Related Art

It is well known that various cleavage reactions are assisted by silver ions including reactions involving cleavage of a compound into one or more fragments.

U.S. Pat. No. 3,719,489 discloses silver ion assisted cleavage reactions useful in photographic systems. As disclosed therein, photographically inert compounds are capable of undergoing cleavage in the presence of silver ions made available imagewise during processing of a silver halide emulsion to liberate a reagent, such as, a photographically active reagent or a dye in an imagewise distribution corresponding to that of said silver ions. In one embodiment disclosed therein, color images are produced by using as the photographically inert compounds, color providing compounds which are substantially non-diffusible in the photographic processing composition but capable of undergoing cleavage in the presence of the imagewise distribution of silver ions and/or soluble silver complex made available in the undeveloped and partially developed areas of a silver halide emulsion as a function of development to liberate a more mobile and diffusible color-providing moiety in an imagewise distribution corresponding to the imagewise distribution of said ions and/or said complex. The subsequent formation of a color image is the result of the differential in diffusibility between the parent compound and liberated color-providing moiety whereby the imagewise distribution of the more diffusible color-providing moiety released in the undeveloped and partially developed areas is free to transfer.

Color-providing compounds useful in the above process form the subject matter of U.S. Pat. No. 4,098,783, a continuation in part of said U.S. Pat. No. 3,719,489. The color-providing compounds disclosed therein may comprise one or more dye radicals and one or more 1,3-sulfur-nitrogen moieties. For example, they may comprise one complete dye or dye intermediate and one cyclic 1,3-sulfur-nitrogen moiety. Alternatively, the color-providing compounds may comprise two or more cyclic moieties for each dye radical or dye intermediate and vice versa. Particularly useful dye-providing compounds disclosed therein comprise a dye containing from 1 to 4 and preferably 1 or 2 cyclic 1,3-sulfur-nitrogen groups and may be represented by the formula $$D—[(L)_{m-1}—Y]_n \quad (A)$$

wherein D represents a dye radical, i.e., the radical of an organic dye possessing at least one carbon atom, L is a divalent organic linking group containing at least one carbon atom, m is a positive integer 1 or 2, n is a positive integer from 1 to 4, and Y is a cyclic 1,3-sulfur-nitrogen group.

Thermally developable black and white as well as color photosensitive materials, which are imaged by light exposure and developed by heating, are well known. Among the systems designed to give color images are those wherein a diffusible dye is released as a result of the heat development of an organic silver salt and transferred to the image-receiving layer, whereby a color image is obtained.

Japanese Kokai 59-180548 having a Laid-Open date of Oct. 13, 1984 discloses a heat-developable silver halide photosensitive imaging system wherein the dye-providing material contains a heterocyclic ring containing a nitrogen atom and a sulfur or selenium atom which heterocyclic ring is subject to cleavage in the presence of silver ions to release a diffusible dye. An example of a suitable dye-providing material is a thiazolidine dye such as disclosed in the aforementioned U.S. Pat. No. 4,098,783. The process involves imagewise exposing the photosensitive system to light and subsequently or simultaneously heating the photosensitive system, in the presence of a base or base precursor, under a substantially water-free condition whereby an oxidation-reduction reaction between the exposed photosensitive silver halide and a reducing agent occurs. In the exposed areas a negative silver image is formed. In the unexposed areas, the silver ion, present in inverse proportion to the silver image, causes the heterocyclic ring of the dye-providing material to be cleaved releasing a diffusible dye. The diffusible dye is then transferred to an image-receiving layer whereby a positive dye image is formed.

A heat-developable photosensitive system useful in terms of thermal development of the silver halide latent image is one which comprises a support carrying a photosensitive silver halide, a silver salt oxidizer, a thermal solvent, a reducing agent for the silver salt, a binder, preferably gelatin, a dye-providing material capable of releasing dye upon silver ion assisted cleavage, and on the same or a separate support, an image-receiving layer capable of receiving the released dye. However, the use of conventional silver salt oxidizing materials has caused problems in this thermal system. Some of the salts have inadequate solubility in the thermal solvent, e.g., silver salts of compounds having an imino group such as silver benzotriazole and silver imidazole, so that there is an insufficient amount of soluble silver ion and/or silver salt complex available to cleave the dye-providing material. Other silver salt oxidizing materials, while they may have adequate solubility in the thermal solvents, bind the silver too weakly, e.g. silver saints of fatty acids such as silver behenate and silver stearate, so that there is release of dye during coating.

These problems are also present in thermographic color transfer imaging systems comprising a support carrying a dye-providing material capable of releasing a diffusible dye upon silver ion assisted cleavage, a binder, a thermal solvent, a silver salt, and on the same or a separate support an image-receiving layer capable of receiving the diffusible dye. These thermographic systems are imaged and developed by heat exposure. The process involves imagewise heating the thermographic image-recording material causing dissolution of the silver ions in an imagewise manner corresponding to said imagewise heating where they are then available to cleave the dye-providing material to release a diffusible dye in an imagewise pattern corresponding to said imagewise heating. The diffusible dye then transfers to the image-receiving sheet to form a dye image therein.

One attempt at solving the silver ion solubility problem has been to add an auxiliary ligand to the photothermographic or thermographic system such as disclosed in the copending U.S. patent application of James R. Freedman, et al, Ser. No. 07/923,858, filed Jul. 31, 1992, and assigned to the same assignee as the present application, now abandoned in favor of U.S. Ser. No. 08/079,146 filed Jun. 17, 1993. The auxiliary ligand is soluble in the thermal solvent and forms a complex with the silver ions. Including the auxiliary ligand in the photothermographic and/or thermographic system gives higher image densities, better image discrimination and accelerated silver development when compared with the same system(s) without an auxiliary ligand.

U.S. Pat. No. 4,260,677, issued Apr. 7, 1981, describes black and white thermographic and photothermographic materials wherein an image in reduced silver is formed. The thermographic materials comprise at least one layer comprising a binder, a reducing agent, and at least one silver salt complexed by at least one coordinating compound (ligand) having a gross stability constant between 4.50 and 10.00 wherein at least 90% of all silver salt within the layer is in the form of a silver salt complex with said at least one coordinating compound. The silver salt complex may be preformed or it may be formed in situ. Preferred coordinating ligands are described as those compounds containing an imidazole group. An advantage of the complexed silver salts is stated to be ease of coatability, i.e., that the complexes may be coated as a solution rather than a dispersion since the complexes dissolve in most coating solvents.

SUMMARY OF THE INVENTION

According to the present invention, a silver salt complex as defined below is utilized in a thermographic dye transfer image-recording material as the source of silver ions made available upon imagewise heating to cleave a dye-providing material thereby releasing a diffusible dye in an imagewise manner corresponding to said imagewise heating. The diffusible dye then transfers to an image-receiving layer whereby a dye image is formed corresponding to said imagewise heating. The silver salt complexes described herein have the necessary solubility in the thermal solvents so that silver ion and/or soluble silver complex is available to cleave the dye-providing material providing for transferred dye images have enhanced image density.

The present invention, therefore, provides thermographic dye transfer image-recording materials containing a silver salt complex as the source of soluble silver ions and/or soluble silver complex.

Other objects of the invention will in part be obvious and will in part appear hereinafter.

The invention accordingly comprises the processes involving the several steps and relation and order of one or more of such steps with respect to each of the others, and the product and compositions possessing the features, properties and relation of elements which are exemplified in the following detailed disclosure, and the scope of the application of which will be indicated in the claims.

For a fuller understanding of the nature and objects of the invention, reference should be had to the following detailed description.

DETAILED DESCRIPTION OF THE INVENTION

The present invention provides a thermographic dye transfer image-recording material comprising (i) one or more supports each carrying in one or more layers a dye-providing material capable of releasing a diffusible dye upon cleavage in the presence of silver ions and/or a soluble silver complex, a thermal solvent, a binder and a silver salt complex formed by the combination of a) one monovalent silver ion;

b) at least one coordinating ligand, the ligand(s) having all its available ligating sites coordinated to said one monovalent silver ion, said ligand(s) being sufficient to fully coordinate said silver ion, i.e., the silverion is incapable of accepting lone pairs of electrons from any other potential donating atom or ligand; and, c) a monovalent anion having a silver binding constant of less than 1; said silver salt complex having a gross stability constant between 2.5 and 12; and, (ii) on the same or a separate support an image-receiving layer capable of receiving the diffusible dye released from said dye-providing material.

It will be understood that if the ligand itself is charged, a counterion in addition to the monovalent anion may be necessary to maintain the neutrality of the complex. If the counterion is an anion, it should have a silver binding constant of less than 1.

As used above, a "ligating site" is an electron pair on an atom, typically N, P, As, S or Se, of the coordinating ligand which is available to be either donated to or shared with a silver ion. Any shared or unshared pairs of electrons on the ligand(s) which have a silver binding constant of less than 1 are not "ligating sites" for purposes of the present invention. To be useful in the present invention, the ligand must have 1 to 4 ligating sites and these must necessarily be situated on the ligand so that all the ligating sites can be bound to the same silver ion otherwise the uncoordinated electron pairs are available to form solid state oligomers such as discussed in *Gmelin HBh Anorg. Chem.*, Teil B-6, 133 (1975) for pyrazole. These oligomers are not sufficiently soluble in the thermographic system upon heating so that silver ions are not readily available during processing to cleave the dye-providing material. For example, the silver salt complexes of imidazole (a) and benzotriazole (b), shown in FIG. 1 below, would not be useful in the present invention since the lone pair of electrons on the N atom in the 3-position of each ligand would be an uncoordinated ligating site available to form solid state oligomers such as shown in FIG. 2 for imidazole.

FIGURE 1

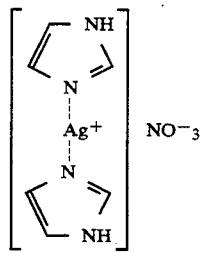

(a)

-continued
FIGURE 1

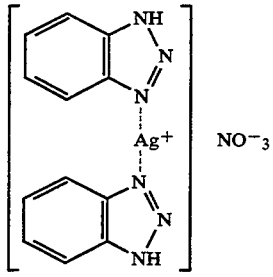

(b)

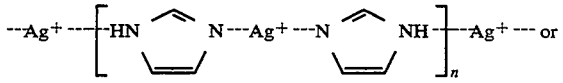

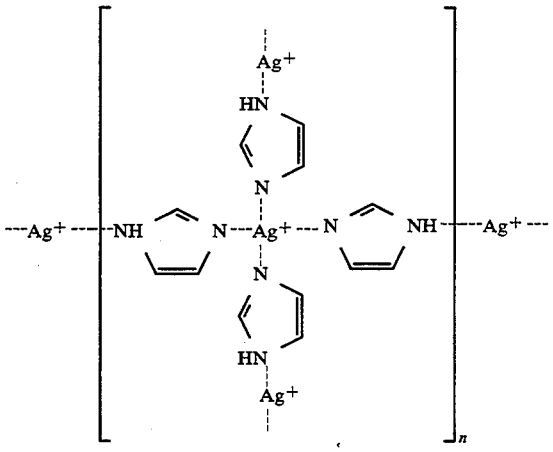

wherein n represents the number of repeating units in the polymeric chain.

FIGURE 2

As stated above, the ligand(s) must be chosen such that the monovalent silver ion in each of the silver salt complexes according to the present invention is fully coordinated, i.e., it is incapable of accepting electrons from any other potential donating atom or ligand.

If multiple ligands are required to form a particular silver salt complex, it is preferable that the ligands be the same.

Those silver salt complexes formed by the combination of a) one monovalent silver ion;

b) at least one coordinating ligand, the ligand(s) having all its available ligating sites coordinated to said one monovalent silver ion, said ligand(s) being sufficient to fully coordinate said silver ion, i.e., the silver ion is incapable of accepting lone pairs of electrons from any other potential donating atom or ligand; and, c) a monovalent anion having a silver binding constant of less than 1; tend to be more soluble in thermal solvents relative to other types of silver salt complexes and silver salts.

The silver salt complexes used in the thermographic image-recording materials according to the present invention preferably have solubilities in the chosen thermal solvent (generally measured at temperatures 20°–30° above the melting point of the thermal solvent) of at least 0.5% (wt/wt), and generally at least 1% (wt/wt).

To be useful in the thermographic image-recording materials of the present invention, the silver salt complexes should have a gross or cumulative stability constant ($\beta_n$ value) of between 2.5 and 12. Complexes with $\beta_n$ values less than 2.5 tend to have poor shelf life, i.e., they cause release of the dye-providing material prior to heat processing thereby compromising image resolution. Those having $\beta_n$ values greater than 12 bind the silver too tightly so that the silver ions are not sufficiently available during processing to cleave the dye-providing material.

The gross or cumulative stability constant ($\beta_n$ value) is a measure of the stability of a particular metal ion-ligand complex. In the practice of the present invention, $\beta_n$ values represent the stability of the silver salt complexes in aqueous solutions. $\beta_n$ is defined as the sum of the logarithms of the individual silver binding constants for each ligand attached to the silver ion. Thus, $$\beta_n = \sum_{i=1}^{n} \log K_i$$

wherein:

n represents the number of ligand molecules bound to the silver atom, $K_n$ represents the individual stability constants for each ligand (n) attached to the $Ag^+$ion, i.e., the silver binding constant, and is represented by $$K_n = \frac{[AgL_n]}{[AgL_{n-1}][L]}$$

ps wherein:

n is as defined above;

$[AgL_n]$ is the concentration of the silver complex with n ligands;

[L] is the free ligand concentration;

$[AgL_{n-1}]$ is the concentration of the silver complex with n-1 ligands.

For a discussion of $\beta_n$ values, see e.g., Martell, A. E. and Sillen, L. G., *Stability Constants of Metal-Ion Complexes*, The Chemical Society of London, 1964, pp. xi–xii. A procedure generally used to measure the gross stability constants can be found in *Can. J. Chem.*, 1967, 45, 2729–2739.

The ligands may be organic or inorganic. Suitable ligands include the 2,2'-bipyridines, e.g., 2,2'-bipyridine, 4,4'-dimethyl-2,2'-bipyridine, 4,4'-diphenyl-2,2'-bipyridine and 2,2'-biquinolines; derivatives of 1,10-phenanthroline bearing electron-withdrawing substituents, e.g., 5-chloro-1,10-phenanthroline and 5-nitro-1,10-phenanthroline; and 2-p-tolylsulfonamidothioanisole.

The gross stability constants of the various silver salt complexes can be varied by selecting substituents for substitution on the ligands. For example, substituting electron withdrawing groups on a particular ligand will generally decrease the gross stability constant while electron donating groups will have the opposite effect. An electron withdrawing group is a group having a positive sigma value as defined by Hammett's Equation. An electron donating group is a group having a negative sigma value. For a discussion of the Hammett Equation and its relationship to substituent effects, see, e.g., Otto Exner, "A Critical Compilation of Substituent Constants" Chapter 10 (pp 439–540) in *Correlation Anal-*

*ysis in Chemistry*, N. B. Chapman and J. Shorter, eds. Plenum Press: New York, 1978.

The monovalent anion must have a silver binding constant less than 1 and may be a separate anion, such as, nitrate, perchlorate, or an anion of an organic acid, e.g., a carboxylic, sulfonic or nitrogen based acid, or the monovalent anion may be present on the ligand itself, e.g., where a deprotonated carboxylic acid group, deprotonated amine group or other negatively charged species is present on the coordinating ligand. The silver binding constants (taken from A. E. Martell and R. M. Smith, *Critical Stability Constants*, vol. 1-6, Plenum Press, New York, 1974–1989) for some common monovalent anions are listed in Table 1.

TABLE 1

| ANIONS | SILVER BINDING CONSTANTS |
|---|---|
| Nitrate | 0.34 |
| Tosylate | 0.1 |
| Benzoate | 0.5 |
| Bromide | 4.7 |
| Chloride | 3.3 |
| Iodide | 6.6 |

Some specific examples of silver salt complexes formed by the combination of a) one monovalent silver ion;

b) at least one coordinating ligand, the ligand(s) having all its available ligating sites coordinated to said one monovalent silver ion, said ligand(s) being sufficient to fully coordinate said silver ion, i.e., the silver ion is incapable of accepting lone pairs of electrons from any other potential donating atom or ligand; and, c) a monovalent anion having a silver binding constant of less than 1; are set out in Table 2 along with their solubilities in the thermal solvent designated TS-1 (the structure of which is shown below) and their $\beta_n$ values (taken from A. E. Martell and R. M. Smith, *Critical Stability Constants*, vol. 1-6, Plenum Press, New York, 1974–1989), where available.

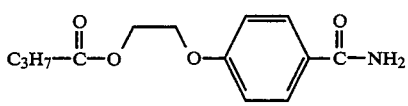

TS-1

As comparisons, Table 2also includes the solubilities of three silver salt complexes which do not fall within the above-described definition, as well as five silver salts. A silver salt is defined herein as a compound formed when the hydrogen of an acid is replaced by a silver ion.

TABLE 2

| SILVER SALT COMPLEX | SOLUBILITY IN TS-1 (wt/wt) | $\beta_n$ VALUES |
|---|---|---|
| Silver(2,2'-bipyridyl)$_2$ nitrate | >2% | $\beta_2 = 6.7$ |
| Silver(2,2'-bipyridyl)$_2$ tosylate | >2% | $\beta_2 = 6.7$ |
| Silver(2,2'-bipyridyl)$_2$ octanesulfonate | >2% | $\beta_2 = 6.7$ |
| Silver(2,2'-bipyridyl)$_2$ toluate | >2% | $\beta_2 = 6.7$ |
| Silver(4,4'-dimethyl-2,2'-bipyridyl)$_2$ octanesulfonate | >2% | n/a |
| Silver(4,4'-diphenyl-2,2'-bipyridyl)$_2$ tosylate | 2% | n/a |

TABLE 2-continued

| SILVER SALT COMPLEX | SOLUBILITY IN TS-1 (wt/wt) | $\beta_n$ VALUES |
|---|---|---|
| Silver(2,2'-biquinoyl)$_2$ tosylate | >2% | n/a |
| Silver(1,10-phenanthroline)$_2$ nitrate | 0.2% | $\beta_4 = 12.1$ |
| Silver(5-chloro-1,10-phenanthroline)$_2$ tosylate | 1% < x < 2% | 11.0 |
| Silver(5-nitro-1,10-phenanthroline)$_2$ tosylate | 2% | n/a |
| Silver(triphenylphosphine)$_4$ nitrate | 0.5% < x < 1% | $\beta_4 > 20$ |
| Silver(cyclohexylisonitrile)$_4$ nitrate | >2% | n/a |
| Silver(t-butylisonitrile)$_4$ nitrate | >2% | n/a |
| Silver(2-p-tolylsulfonamidothioanisole) | 2% | n/a |
| Silver(4,5-diazafluorene)$_2$ tosylate | >2% | n/a |
| Silver(6,7-dihydro-5,8-dimethyldibenzo-[b,j] [1,10] phenanthroline)$_2$ tosylate | >1.4% | n/a |

In Table 2, n/a denotes the information is not available and x designates solubility.

The structure of silver(2-p-tolylsulfonamidothioanisole), appearing in Table 2 is represented by

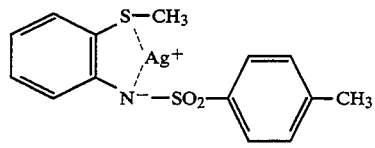

The solubility of silver(2,2'-bipyridyl)$_2$ nitrate (Ag(2,2'-bipyridyl)$_2NO_3$) compared with silver benzotriazole (AgBzt) in other thermal solvents is shown in Table 3. The temperatures at which the solubility testing was conducted is indicated in parentheses next to the thermal solvent. The variations in the temperatures reflect the differing melting points of the chosen thermal solvents.

TABLE 3

| THERMAL SOLVENT | SILVER COMPOUND | SOLUBILITY (wt/wt) |
|---|---|---|
| Urea (140° C.) | Ag(2,2'-bipyridyl)$NO_3$ | 2% |
| | AgBzt | <0.2% |
| m-Toluamide (120° C.) | Ag(2,2'-bipyridyl)$NO_3$ | 2% |
| | AgBzt | <0.2% |
| Benzyl phenyl | Ag(2,2'-bipyridyl)$NO_3$ | >2% |
| Sulfoxide (130° C.) | AgBzt | <0.2% |
| bis(Phenylsulfonyl) | Ag(2,2'-bipyridyl)$NO_3$ | >2% |
| methane (130° C.) | AgBzt | <0.2% |
| Acetamide (120° C.) | Ag(2,2'-bipyridyl)$NO_3$ | >2% |
| | AgBzt | <0.2% |

As the data in Tables 2 and 3 demonstrate, the silver salt complexes formed by the combination of a) one monovalent silver ion;

b) at least one coordinating ligand, the ligand(s) having all its available ligating sites coordinated to said one monovalent silver ion, said ligand(s) being sufficient to fully coordinate said silver ion, i.e., the silver ion is incapable of accepting lone pairs of electrons from any other potential donating atom or ligand; and, c) a monovalent anion having a silver binding constant of less than 1; have enhanced solubility in thermal solvents relative to other silver salt complexes and to silver salts.

It will be noted that only those silver salt complexes listed in Table 2 which have a gross stability constant of between 2.5 and 12 are suitable for use in the thermographic image-recording materials of the present invention.

Those silver salt complexes described for use in the present invention wherein the monovalent anion is a separate anion are generally prepared by adding a solution of the silver salt of the desired monovalent anion, e.g., silver nitrate, to a solution of the ligand, cog., 5-nitro-1,10-phenanthroline to precipitate the silver salt complex such as described in Hall et al, *Austr. J. Chem.*, 1966, 19, 197–200. Water may be required to aid in precipitation. Those silver salt complexes wherein the monovalent anion is an ancillary group on the ligand itself are generally prepared by adding a solution of a silver salt, e.g. silver nitrate, to a solution of the appropriate deprotonated ligand. It may be necessary to add a base or another salt to the mixture in order to solubilize the silver salt, e.g., ammonium hydroxide may be added to solubilize the silver nitrate. Still other procedures for preparing the silver salt complexes and further variations of those given above will be apparent to those skilled in the art.

The following detailed examples are given to illustrate the preparation of the silver salt complexes within the scope of the present invention, and are not intended to be in any way limiting.

EXAMPLE 1

Nine silver salt complexes according to the present invention having the monovalent anion as a separate anion were prepared according to the procedure described below for silver(2,2'-bipyridine)$_2$ nitrate by substituting the appropriate ligand and/or silver salt as indicated in Table 4. The ligands listed in Table 4 were all commercially available.

Preparation of silver(2,2'-bipyridine)$_2$ nitrate

To a solution of 3.40 g of silver nitrate in 15 ml of hot acetonitrile was added a solution of 3.12 g 2,2'-bipyridine in 50ml of hot acetonitrile. The resulting solution was heated on a steam bath for 15 minutes and then cooled to room temperature. The mixture was diluted with water to form a pale yellow precipitate which was filtered, washed with water and dried in vacuo to yield 3.0 g of silver(2,2'-bipyridine)$_2$ nitrate.

Elemental Analysis (%). Found: Ag: 22.01; C: 47.35; N: 14.11. Calc: Ag: 22.36; C: 49.81; N: 14.52.

TABLE 4

| SILVER SALT COMPLEX | LIGAND | SILVER SALT |
|---|---|---|
| Silver(2,2'-bipyridyl)$_2$ nitrate | 2,2'-bipyridine | Silver nitrate |
| Silver(2,2'-bipyridyl)$_2$ tosylate | 2,2'-bipyridine | Silver tosylate |
| Silver(2,2'-bipyridyl)$_2$ octanesulfonate | 2,2'-bipyridine | Silver octanesulfonate |
| Silver(2,2'-bipyridyl)$_2$ toluate | 2,2'-bipyridine | Silver toluate |
| Silver(4,4'-dimethyl-2,2'-bipyridyl)$_2$ octanesulfonate | 4,4'-dimethyl-2,2'-bipyridine | Silver octanesulfonate |
| Silver(4,4'-diphenyl-2,2'-bipyridyl)$_2$ tosylate | 4,4'-diphenyl-2,2'-bipyridine | Silver tosylate |
| Silver(2,2'-biquinoyl)$_2$ tosylate | 2,2'-Biquinoline | Silver tosylate |
| Silver(5-nitro-1,10-phenanthroline)$_2$ tosylate | 5-nitro-1,10-phenanthroline | Silver tosylate |
| Silver(5-chloro-1,10-phenanthroline)$_2$ tosylate | 5-chloro-1,10-phenanthroline | Silver tosylate |

EXAMPLE 2

Preparation of Silver(2-p-tolylsulfonamidothioanisole)

To 1.5 g of 2-p-tolylsulfonamidothioanisole in 40 mL of distilled water was added 0.64 g of 45% potassium hydroxide solution. The resulting mixture was heated on a steam bath to obtain a clear solution. The solution was then cooled in an ice bath. To the cooled solution was added 0.5 mL concentrated ammonium hydroxide followed by the addition, all at once, of a solution of 0.85 g of silver nitrate in 15 mL of distilled water to which had been added sufficient concentrated ammonium hydroxide to obtain a clear solution. The resulting white precipitate was filtered, washed with water. and dried in vacuo to yield 2.0 g of silver (2-p-tolylsulfonamidothioanisole).

The 2-p-tolylsulfonamidothioanisole used above was prepared as follows. A solution of 69.2 g 2-(methylmercapto)aniline and 44 mL of pyridine in 300 mL methylene chloride was chilled in an ice bath. To the solution was added, portionwise, a suspension of 100 g p-toluenesulfonyl chloride over 30 minutes maintaining the temperature between 10°–20° C. The resulting mixture was stirred for 3 hours and then poured into ice water containing 200 mL concentrated hydrochloric acid. After stirring for 20 minutes, the organic phase was separated, washed with water, dried over anhydrous sodium sulfate and concentrated. The resulting residue was slurried with water, filtered and dried in vacuo at 50° C. to yield 126.3 g 2-p-tolylsulfonamidothioanisole, mp 148°–1350° C.

Elemental Analysis (%). Found: Ag: 24.13; C: 42.30; N: 3.53; H: 3.73; S: 16.62. Calc: Ag: 26.94; C: 42.05; N: 3.49; H: 3.52; S: 16.02.

Because of the improved solubility of the above described silver salt complexes in thermal solvents, using the silver salt complexes in the color thermographic image-providing materials of the present invention, provided they have the requisite $\beta_n$ value, allows for increased cleavage of the dye-providing materials resulting in enhanced image density in the transferred image.

In a preferred embodiment, the thermosensitive image-recording material is processed and the dye transferred in the absence of a base or base precursor and under substantially water free conditions, i.e., water is not intentionally added. Base precursors are materials which generate a base under the processing conditions. It is recognized that while certain of the counterions necessary for electroneutrality of the silver salt complexes may be classified as weak bases, such counterions would not be considered bases or base precursors as those terms are used in Japanese Kokai No. 59-180548.

The silver salt complex may be present in any layer of the thermographic image-recording material of the present invention including the image-receiving layer, but is preferably in a separate layer coated over the layer containing the dye-providing material. It may also be present in a layer on the image-receiving layer, in which case the layer also preferably contains a thermal solvent in which the silver salt complex is soluble and a binder.

The silver salt complexes are generally used in amounts which yield, after drying, a ratio of 0.5 to 10 mmol silver ion/mmol silver ion cleavable moiety and preferably 0.5 to 2 mmol of silver ion/mmol silver ion cleavable moiety. The term "mmol silver ion cleavable moiety" is used to denote the mmol of silver cleavable moiety on the dye-providing material which must be cleaved by the silver ion in order to release one mmol of diffusible dye.

Thermal solvents are compounds which are solids at ambient temperature but which melt at or below the temperature used for processing. The thermal solvent acts as a solvent for various components of the thermographic image-recording material and it provides the medium for diffusion of various materials including silver ions and/or silver salt complexes and the released dyes. Illustrative thermal solvents useful in the present invention include polar organic compounds such as sulfoxides, the polyglycols described in U.S. Pat. No. 3,347,675 and the compounds described in U.S. Pat. No. 3,667,959. Particularly useful compounds include urea derivatives, e.g., dimethylurea, diethylurea and phenylurea; amide derivatives, e.g., acetamide, benzamide and p-toluamide; sulfonamide derivatives, e.g., benzenesulfonamide and α-toluenesulfonamide; and polyhydric alcohols, e.g., 1,2-cyclohexanediol and pentaerythritol. The thermal solvent, TS-1, shown above, has been found to give good results in the present invention.

The thermal solvent is generally incorporated on or in the image-receiving layer and/or in the thermosensitive imaging layer(s) of the present invention. However, it may also be added to any intermediate layers and protective layers where necessary to obtain a desired result.

The thermal solvent is generally added in each layer in amounts ranging from 0.5 to 10.0 g/m$^2$, preferably 0.5 to 3.0 g/m$^2$.

The thermosensitive imaging layer(s) and other layers of the thermographic image-recording material may contain various materials as binders. Suitable binders include water soluble synthetic high-molecular weight compounds such as polyvinyl alcohol and polyvinylpyrrolidone and, synthetic or natural high-molecular weight compounds such as gelatin, gelatin derivatives, cellulose derivatives, proteins, starches and gum arabic. A single binder or mixture of binders may be used. Gelatin is the preferred binder for use in each layer.

The amount of binder used in each layer is generally 0.5 to 5.0 g/m$^2$, preferably 0.5 to 3.0 g/m$^2$.

The layers of the thermographic system according to the present invention which contain a crosslinkable colloid as a binder, e.g., gelatin, can be hardened by using various organic and inorganic hardeners such as those described in T. H. James, The *Theory of the Photographic Process*, 4th Ed., MacMillan, 1977, pp. 77–87. The hardeners can be used alone or in combination. Any suitable hardener known in the photographic art may be employed, however, aldehyde hardeners, e.g., succinaldehyde and glyoxal, have been found to be particularly useful when gelatin is employed as the binder.

Hardeners are generally used in amounts ranging from 1 to 10% by weight of the total amount of gelatin coated.

The dye-providing material to be used in the present invention must be substantially non-diffusible in the thermosensitive imaging composition but capable of undergoing cleavage in the presence of the imagewise distribution of silver ions and/or soluble silver complex made available upon imagewise heating to liberate a more mobile and diffusible color-providing moiety in an imagewise distribution corresponding to the imagewise distribution of said ions and/or said complex. Suitable dye-providing materials are those containing at least one heterocyclic ring having a 1,3sulfur-nitrogen moiety and at least one dye radical, which heterocyclic ring is subject to a cleavage reaction in the presence of silver ions and/or a soluble silver complex to release a diffusible dye, such as those disclosed in the aforementioned U.S. Pat. No. 4,098,783 of R. F. W. Cieciuch et al and U.S. Pat. No. 5,316,887 of M. J. Arnost et al filed on Jul. 31, 1992. Preferred dye-providing materials include both the thiazolidine dye-providing materials disclosed in U.S. Pat. No. 4,098,783 which are represented by the formula $$D'-[(L')_{m-1}-Y']_n$$

Formula I wherein D' represents the radical of an organic dye; m is a positive integer 1 or 2; n is a positive integer from 1 to 4; L' represents a divalent organic linking group; and Y' is a cyclic moiety represented by the structure

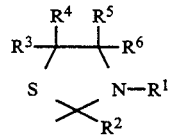

wherein $R^1$ is hydrogen, alkyl containing 1 to 20 carbon atoms, unsubstituted or substituted, alkoxy containing 1 to 20 carbon atoms, and phenyl, substituted or unsubstituted; $R^2$ represents hydrogen or a monovalent organic radical; and $R^3$, $R^4$, $R^5$ and $R^6$ are each hydrogen or alkyl containing 1 to 20 carbon atoms, said cyclic moiety being attached to an aromatic nuclear carbon atom of said D' by a single covalent bond when m is 1 and being attached to a carbon atom of said divalent organic linking group by a single covalent bond when m is 2 and said C atom common to said S and N atoms of said cyclic moiety being a tetrahedral carbon atom possessing 4 single covalent bonds; and the bis(thiazolidine dyes) disclosed in the aforementioned copending U.S. patent application of Michael J. Arnost et al, Ser. No. 07/923,843 and represented by the Formula

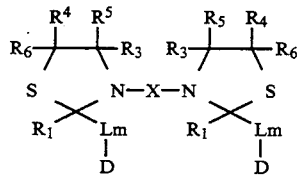

Formula II

Formula II wherein D represents a complete dye, i.e., a dye radical of an organic dye; L represents a divalent organic linking group containing at least one carbon atom; m is 0 or 1; X represents a chemical linkage joining the two cyclic 1,3-sulfur-nitrogen groups; $R_1$ represents hydrogen, a monovalent organic radical or together with L represents the atoms necessary to complete a spiro union with one of the cyclic 1,3sulfur-nitrogen groups when m is 1 or together with D represents the atoms necessary to complete a spiro union with one of the cyclic 1,3-sulfur-nitrogen groups when m is 0; and $R_3$, $R_4$, $R_5$ and $R_6$ are each independently hydrogen, a monovalent organic radical or taken together, $R_3$ and $R_4$ or $R_5$ and $R_6$ represent a substituted or unsubstituted carbocyclic or heterocyclic ring.

The dye-providing materials may be prepared by procedures described in the aforementioned U.S. Pat. No. 4,098,783 and the aforementioned copending U.S. Pat. No. 5,316,887 of M. J. Arnost et al.

The dye-providing material may be added in the same layer as the silver salt complex or in a layer on either side of the silver salt complex layer. In certain instances, it may be desirable to separate the dye-providing material from the silver salt complex layer by a spacer layer. Where the particular dye-providing material chosen tends to be migratory during storage and/or thermal processing of the thermographic system, it is preferred that the dye-providing material be in a separate layer and more preferably, that it be in a layer furthest from the image-receiving layer.

The amount of dye-providing material used varies with the type chosen but generally an amount of 0.25 to 2.0 mmol/$m^2$ is used.

The dye-providing materials may be incorporated into the desired layer(s) of the thermographic image-recording material by any suitable method. For example, the dye-providing materials can be dissolved in a low boiling and/or high boiling solvent and dispersed in the binder, they can be dispersed in aqueous solutions of suitable polymers, e.g., gelatin, by means of a ball mill, or they can be solvent coated using any organic solvent that will also dissolve the selected binder, e.g., trifluoroethanol or dimethylsulfoxide (DMSO) can be used when gelatin is the binder.

The support for the image-recording elements according to the present invention must necessarily be able to withstand the heat required for processing the image, and any suitable support known in the art can be employed. Specific examples of suitable supports include synthetic plastic films, such as, a polyester film, a polyvinyl chloride film or a polyimide film and paper supports, such as, photographic raw paper, printing paper, baryta paper and resin-coated paper. Preferably, a polyester film is used.

A subcoat may be added to the face of the support which carries the thermosensitive imaging materials in order to increase adhesion. For example, a polyester base coated with a gelatin subcoat has been found to enhance adhesion of aqueous based layers.

The thermographic dye transfer image-recording material according to the present invention can be used to form monochrome or multicolor images. Full color images can be obtained by using overlays of the three subtractive primaries, yellow, magenta and cyan. A black overlay may also be necessary to obtain true full color reproduction. This may be achieved by employing three (or four) separate thermosensitive sheets, each designed to release a different diffusible dye. The image to be reproduced is generally separated into its blue, green and red components and each color record is sequentially printed in registration, using the corresponding thermosensitive sheet, on the same receiving sheet in a manner analogous to that used in conventional dye diffusion thermal transfer processes. See, for example, Advanced Printing of Conference Summaries, SPSE's 43rd Annual Conference, May 20–25, 1990, pp 266–268, SPSE, Springfield, VA, D. J. Harrison, Thermal Dye Transfer Hard Copy Chemistry and Technology, Eastman Kodak Company, Rochester, N.Y.

The thermographic dye transfer image-recording materials of the present invention include those wherein the thermosensitive imaging layer(s) and the image-receiving layer are initially contained in separate elements which are brought into superposition subsequent or prior to heating. After heating the two layers may be retained together in a single element, i.e., an integral unit or they can be peeled apart from one another. Alternatively, rather than being in separate elements, the thermosensitive layer(s) and the image-receiving layer may initially be in a single element therein the two components are contained in a thermosensitive laminate or otherwise retained together in an integral structure. After heating, the two layers may be retained together as a single element or they can be peeled apart from one another. Where the imaging layer(s) and the image-receiving layer are retained together as an integral unit, a masking layer, e.g., titanium dioxide, may be necessary to conceal the untransferred dye-providing material from the final image.

In carrying out the present invention, heat is generally applied so as to obtain temperatures in the range of 80° to 200° C., preferably in the range of 100° to 150° C.

The method by which the heat is applied or induced imagewise may be realized in a variety of ways, for example, by direct application of heat using a thermal printing head or thermal recording pen or by conduction from heated image-markings of an original using conventional thermographic copying techniques. Selective heating can be produced in the heat-sensitive element itself by the conversion of electromagnetic radiation into heat and preferably, the light source is a laser beam emitting source such as a gas laser or semiconductor laser diode. The use of a laser beam is not only well suited for recording in a scanning mode but by utilizing a highly concentrated beam, radiant energy can be concentrated in a small area so that it is possible to record at high speed and high density. Also, it is a convenient way to record data as a heat pattern in response to transmitted signals such as digitized information and a convenient way of preparing multicolor images by employing a plurality of laser beam sources that emit laser beams of different wavelengths.

If using an infrared emitting laser, the thermo-sensitive material also contains an infrared absorbing substance for converting infrared radiation into heat. Obviously, the infrared absorber should be in heat-conductive relationship with the thermosensitive materials, for example, in the same layer as the dye-providing material or in an adjacent layer. The infrared absorber may be an inorganic or organic compound, such as, a cyanine, merocyanine, squarylium or thiopyrylium dye and preferably, is substantially non-absorbing in the visible region of the electromagnetic spectrum., Any image-receiving layer which has the capability of receiving the released dye may be used in the present invention. Typical image-receiving layers which can be used are prepared by coating a support material with a suitable polymer for receiving the dye. Alternatively, certain polymers may be used as both the support and the dye receiving material.

The image-receiving layer is generally superposed on the thermosensitive imaging layer prior to heating and the two are then heated simultaneously to provide the image and cause the dye to transfer. The image-receiving layer is then generally peeled apart from the image-forming layer(s), although the two can be retained together as described above.

Suitable polymers to be coated on the image-receiving support to receive dye include polyvinyl chloride, poly(methyl methacrylate), polyester, and polycarbonate.

The support materials which may be used for the image-receiving layer can be transparent or opaque. Examples of suitable supports are polymer films, such as, polyethylene terephthalate, polycarbonate, polystyrene, polyvinyl chloride, polyethylene, polypropylene and polyimide. The above supports can be made opaque by incorporating pigments therein, such as, titanium dioxide and calcium carbonate. Other supports include baryta paper, resin coated paper having paper laminated with pigmented thermoplastic resins, fabrics, glass, and metals.

Resin coated paper has been found to be a particularly useful support material for the image-receiving layer according to the present invention.

Additionally, the thermographic image-recording material of the present invention may include other materials heretofore suggested in the art but are not essential. These include, but are not limited to, restrainers, antistatic materials, coating aids e.g., surfactants, activators and the like.

Also, the thermographic image-recording materials may contain additional layers commonly used in the art, such as spacer layer(s) and/or protective layer(s). The protective layer may contain a variety of additives. commonly employed in the art. Suitable additives include matting agents, colloidal silica, slip agents, organofluoro compounds, antioxidants, etc.

The present invention is illustrated by the following specific example.

EXAMPLE 3

Ten silver salt complexes according to the present invention were employed in thermographic dye transfer image-recording materials. Each thermographic image-recording material was the same except for the particular silver salt complex employed.

In each of the ten thermographic imagerecording materials, the particular silver salt complex, the thermal solvent, and the dye-providing material used were added to the coating compositions as dispersions which were prepared by the specific procedures described below. The succinaldehyde was added to the coating compositions as an aqueous solution.

(1) Dispersion of Silver Salt Complex

A mixture of 1.0 g of silver salt complex, 0.44 g of a 11.39% aqueous solution of Daxad 11KLS (potassium salt of a polyalkylnaphthalene sulfonic acid available from W. R. Grace, Organic Chemicals Division, Lexington, Mass.) and 4.56 g of water was ground in a ball mill for 16 hours. 2.0 g of water was introduced for washing purposes during the isolation of the dispersion.

(2) Thermal Solvent Dispersion 64 g of the thermal solvent designated TS-1, above, was dispersed in a mixture of 8.8 g of 10% aqueous polyvinylpyrrolidone and 160.4 g of water. The resulting mixture was ground in a ball mill for 7 hours. 100 g of water was introduced for washing purposes during the isolation of the dispersion.

(3) Dispersion of Dye-Providing Material 1.6 g of dye-providing material, Compound A, having the structure

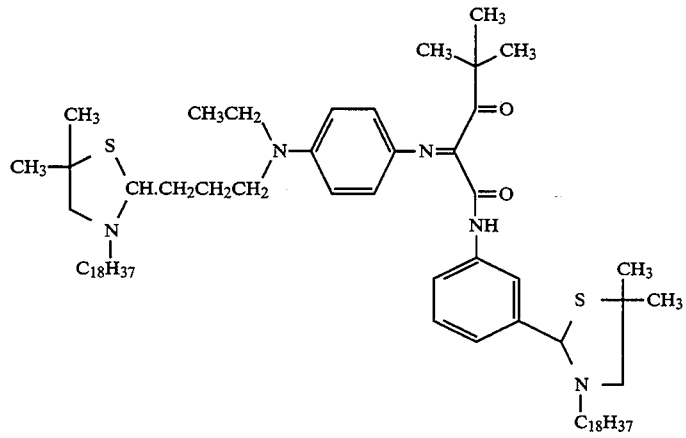

Compound A was dissolved in 5.0 g of ethyl acetate. 0.8 g of tricresylphosphate was added and the mixture was stirred and heated to 42° C. To the mixture at 42° C. was added a solution containing 21 g water, 4 g of 5% aqueous Alkanol XC (available from DuPont, Wilmington, Del.) and 8.5 g of 17.5% aqueous gelatin. The mixture was sonified with an ultrasonic probe for one minute in order to form a dispersion. The dispersion was stirred at 60° C. for 20 minutes to remove the ethyl acetate, followed by the addition of 14.1 g water.

A gelatin subcoated 4 mil polyester film (available from DuPont) was coated using a #30 Meyer Rod with an aqueous composition to yield dry coating coverages of the respective components of layer 1 as follows:

| Layer 1 | |
|---|---|
| Gelatin (Inert, deionized, derivatized bone gelatin, available from Rousselot, France) | 2000 mg/m$^2$ |
| Thermal Solvent (TS-1) | 1500 mg/m$^2$ |
| Dye-providing material (Compound A) | 0.5 mmol/m$^2$ |
| Zonyl FSN | 0.1% by wt. |

-continued

| Layer 1 |
|---|
| (perfluoroalkyl polyethylene oxide non-ionic surfactant, available from DuPont, Wilmington, DE) |

After air drying, layer 1 was overcoated with a composition (applied with a #30 Meyer Rod) to yield coated coverages of the respective components of layer 2 as follows:

| Layer 2 | |
|---|---|
| Gelatin | 3000 mg/m$^2$ |
| Thermal Solvent (TS-1) | 3000 mg/m$^2$ |
| Silver Salt Complex | 2.0 mmol/m$^2$ |
| Succinaldehyde | 100 mg/m$^2$ |
| Zonyl FSN | 0.1% by wt. |

An image-receiving sheet comprising a resin coated paper base overcoated with polyvinylchloride (12 g/m$^2$) was superposed on the thermosensitive imaging material and the assembly was processed at 120° C. for 180 sec at a pressure of 35 psi using a heated plate.

The thermosensitive layers were peeled apart from the image-receiving layer after cooling below the melting point of the thermal solvent (104° C.), approximately 5 sec after processing. The maximum reflection densities (Dmax) of the resulting transferred dye images were measured using a reflection densitometer (MacBeth,, model RD 514). The measured values obtained for each specific silver salt complex are reported in Table 5. In the unheated areas, the measured reflection density was that of the reflective base, 0.05.

To provide controls, four additional thermographic image-recording materials were prepared, imaged, and processed as above, except that in Control (i) there was no silver ion source, in Control (ii), silver benzotriazole was used as the source of silver ion, in Control (iii), silver(benzotriazole)$_2$ tosylate was employed as the source of silver ions and, in Control (iv), silver(1,10-phenanthroline)$_2$ nitrate was the silver ion source. The measured Dmax of the transferred images are reported in Table 5.

TABLE 5

| | Dmax |
|---|---|
| SILVER SALT COMPLEX | |
| Silver(2,2'-bipyridyl)$_2$ nitrate | 0.60 |
| Silver(2,2'-bipyridyl)$_2$ tosylate | 0.97 |
| Silver(2,2'-bipyridyl)$_2$ octanesulfonate | 0.95 |
| Silver(2,2'-bipyridyl)$_2$ toluate | 0.63 |
| Silver(4,4'-dimethyl-2,2'-bipyridyl) octanesulfonate | 0.85 |
| Silver(4,4'-diphenyl-2,2'-bipyridyl) tosylate | 1.02 |
| Silver(2,2'-biquinoyl)$_2$ tosylate | 0.98 |
| Silver(5-chloro-1,10-phenanthroline)$_2$ tosylate | 0.68 |
| Silver(5-nitro-1,10-phenanthroline)$_2$ tosylate | 0.78 |
| Silver(2-p-tolylsulfonamidothioanisole) | 0.49 |
| CONTROLS: | |
| (i) No silver ion source | 0.14 |
| (ii) Silver benzotriazole | 0.25 |
| (iii) Silver(benzotriazole)$_2$ tosylate | 0.35 |
| (iv) Silver(1,10-phenanthroline)$_2$ nitrate | 0.32 |

EXAMPLE 4

A thermographic image-recording material was prepared and processed according to Example 3 using silver(2,2'-bipyridyl)$_2$ octanesulfonate as the silver salt complex and substituting m-toluamide for the TS-1 (thermal solvent). The measured maximum reflection density is reported in Table 6.

To provide controls, two additional thermographic image-recording materials were prepared and processed as above, except that in (i) there was no silver ion source and in (ii) silver benzotriazole was used as the source of silver ions.

TABLE 6

| | Dmax |
|---|---|
| SILVER SALT COMPLEX | |
| Silver(2,2'-bipyridyl)$_2$ octanesulfonate | 0.84 |
| CONTROLS | |
| (i) no silver ion source | 0.09 |
| (ii) Silver benzotriazole | 0.24 |

As Examples 3 and 4 demonstrate, using silver salt complexes defined according to the present invention in the thermographic dye transfer image-recording materials described above provide transferred dye images having enhanced image density relative to the controls.

Since certain changes may be made in the above subject matter without departing from the spirit and scope of the invention herein involved, it is intended that all matter contained in the above description and the accompanying examples be interpreted as illustrative and not in any limiting sense.

We claim:

1. A thermographic non-photosensitive dye transfer image-recording material adapted to be imaged by imagewise heating, said material comprising (i) one or more supports, each carrying in one or more layers a dye-providing material capable of releasing a diffusible dye upon cleavage in the presence of silver ions and/or a soluble silver complex, a thermal solvent, a binder and a silver salt complex formed by the combination of a) one monovalent silver ion;

b) at least one coordinating ligand, the ligand(s) having all its available ligating sites coordinated to said one monovalent silver ion, said ligands being sufficient to fully coordinate said silver ion; and, c) a monovalent anion having a silver binding constant of less than 1; said silver salt complex having a gross stability constant between 2.5 and 12, and, (ii) on the same or a separate support an image-receiving layer capable of receiving the diffusible dye released from said dye-providing material.

2. A thermographic image-recording material according to claim 1 wherein said silver salt complex has a solubility of at least 0.5% wt/wt in said thermal solvent.

3. A thermographic image-recording material according to claim 1 wherein said image-recording material is free of base and base precursor.

4. A thermographic image-recording material according to claim 3 wherein said silver salt complex is in a layer separate from said dye-providing material.

5. A thermographic image-recording material according to claim 4 wherein said silver salt complex is in a layer coated over the layer containing said dye-providing material.

6. A thermographic image-recording material according to claim 4 wherein said silver salt complex is in a layer on said image-receiving sheet.

7. A thermographic image-recording material according to claim 4 wherein the layer comprising the dye-providing material additionally contains a binder for said dye-providing material.

8. A thermographic image-recording material according to claim 7 wherein the layer comprising the dye-providing material additionally contains a thermal solvent.

9. A thermographic image-recording material according to claim 1 wherein said dye-providing material comprises at least one cyclic 1,3-sulfur-nitrogen moiety and at least one complete dye radical.

10. A thermographic image-recording material according to claim 9 wherein said dye-providing material is a thiazolidine dye-providing material.

11. A thermographic image-recording material according to claim 9 wherein said dye-providing material is a bis(thiazolidine dye).

12. A thermographic image-recording material according to claim 1 wherein said thermal solvent has the structure

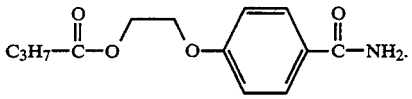

TS-1

13. A thermographic image-recording material according to claim 1 wherein said silver salt complex contains two coordinating ligands.

14. A thermographic image-recording material according to claim 13 wherein both of said coordinating ligands are the same.

15. A thermographic image-recording material according to claim 14 wherein said coordinating ligands are organic.

16. A thermographic image-recording material according to claim 15 wherein said ligands are selected from the group consisting of 2,2'-bipyridines.

17. A thermographic image-recording material according to claim 1 wherein said silver salt complex contains one coordinating ligand.

18. A thermographic image-recording material according to claim 1 wherein said monovalent anion is a separate anion selected from a nitrate or an anion of an organic acid.

19. A thermographic image-recording material according to claim 1 wherein said monovalent anion is present on the coordinating ligand.

20. A thermographic image-recording material according to claim 15 wherein said ligands are selected from the group consisting of derivatives of 1,10-phenanthrolines beading electron withdrawing substituents.

21. A thermographic image-recording material according to claim 7 wherein said binder for the dye-providing material is gelatin.

22. A thermographic image-recording material according to claim 21 wherein said layer containing the dye-providing material has been hardened.

23. A thermographic dye transfer image-recording material comprising:

(i) one or more supports, each carrying in one or more layers a dye-providing material capable of releasing a diffusible dye upon cleavage in the presence of silver ions and/or a soluble silver complex, a thermal solvent, a binder and a silver salt complex formed by the combination of a) one monovalent silver ion;

b) at least one coordinating ligand, the ligand(s) having all its available ligating sites coordinated to said one monovalent silver ion, said ligands being sufficient to fully coordinate said silver ion; and, c) a monovalent anion having a silver binding constant of less than 1;

said silver salt complex having a gross stability constant between 2.5 and 12;

ii) on the same or a separate support an image-receiving layer capable of receiving the diffusible dye released from said dye-providing material; and wherein said silver salt complex includes two identical coordinating ligands selected from the groups: 1) 2,2'-bipyridines, and 2) derivatives of 1,10-phenanthrolines bearing electron withdrawing substituents.

24. A thermographic image-recording material according to claim 23 wherein said silver salt complex is silver (5-nitro-1, 10-phenanthroline)$_2$ tosylate.

25. A thermographic dye transfer image-recording material comprising:

(i) one or more supports, each carrying in one or more layers a dye-providing material capable of releasing a diffusible dye upon cleavage in the presence of silver ions and/or a soluble silver complex, a thermal solvent, a binder and a silver salt complex formed by the combination of a) one monovalent silver ion;

b) at least one coordinating ligand, the ligand(s) having all its available ligating sites coordinated to said one monovalent silver ion, said ligands being sufficient to fully coordinate said silver ion; and c) a monovalent anion having a silver binding constant of less than 1;

said silver salt complex having a gross stability constant between 2.5 and 12;

ii) on the same or a separate support an image-receiving layer capable of receiving the diffusible dye released from said dye-providing material; and wherein said silver salt complex is silver (2-p-tolylsulfonamidothioanisole).

* * * * *

UNITED STATES PATENT AND TRADEMARK OFFICE

CERTIFICATE OF CORRECTION

PATENT NO. : 5,436,108 Page 1 of 3

DATED : Jul. 25, 1995

INVENTOR(S) : M. Freedman, et al

It is certified that error appears in the above-indentified patent and that said Letters Patent is hereby corrected as shown below:

Title page, between the line designated "[22]" and the line designated "[51]" insert

RELATED U.S. APPLICATION DATA

[62] Continuation of Ser. No. 07/994,898, filed December 22, 1992, now abandoned.

Column 2, line 47, "saints" should be ---salts---.

Column 4, line 13, "silverion" should be ---silver ion---.

Column 6, line 35, delete "ps".

Column 7, line 49, "2also" should be ---2 also---.

Column 8, Table 2, under the column headed "$\beta_n$ values", "$\beta_4$=12.1" should read ---$\beta_2$=12.1---.

UNITED STATES PATENT AND TRADEMARK OFFICE

CERTIFICATE OF CORRECTION

PATENT NO. : 5,436,108
DATED : Jul. 25, 1995
INVENTOR(S) : M. Freedman, et al

It is certified that error appears in the above-indentified patent and that said Letters Patent is hereby corrected as shown below:

Column 8, Table 2, add the following:

COMPARATIVE EXAMPLES

| | | |
|---|---|---|
| Silver(2,2'-bipyridyl)iodide | <0.2% | $\beta_1$=3.0 |
| Silver(benzotriazole)$_2$ nitrate | <0.1% | n/a |
| Silver(benzotriazole)$_2$ tosylate | <0.1% | n/a |
| Silver Benzotriazole | <0.02% | $\beta_1$=2.5 |
| Silver 6-Dimethylaminopurine | <0.2% | n/a |
| Silver 3,5-Dimethylpyrazole | <0.2% | n/a |
| Silver Hypoxanthine | <0.2% | n/a |
| Silver Triazole | <0.2% | $\beta_1$=2.6 |

Column 9, line 14, "cog" should read ---e.g.---.

Column 10, line 27, after "water", the period should be deleted.

UNITED STATES PATENT AND TRADEMARK OFFICE

CERTIFICATE OF CORRECTION

PATENT NO. : 5,436,108 Page 3 of 3

DATED : Jul. 25, 1995

INVENTOR(S) : M. Freedman, et al

It is certified that error appears in the above-indentified patent and that said Letters Patent is hereby corrected as shown below:

Column 10, line 44, "1350°C" should read ---150°C---.

Column 12, line 16 "1,3sulfur-nitrogen moiety" should read ---1,3 sulfur-nitrogen moiety---.

Column 13, line 8, "1,3sulfur-" should read ---1,3 sulfur- ---.

Column 14, line 22, "therein" should read --wherein---.

Column 16, line 3, "imagerecording" should read ---image-recording---.

Column 17, line 44, after "The", the hyphen should be deleted.

Signed and Sealed this

Seventh Day of November, 1995

*Attest:*

Bruce Lehman

BRUCE LEHMAN

*Attesting Officer*

*Commissioner of Patents and Trademarks*